United States Patent [19]

Todd

[11] Patent Number: 4,697,733

[45] Date of Patent: Oct. 6, 1987

[54] MAILBOX FLAG EXTENSION DEVICE

[76] Inventor: Donald W. Todd, 162 Zellers Rd., Long Valley, N.J. 07853

[21] Appl. No.: 22,405

[22] Filed: Mar. 6, 1987

[51] Int. Cl.[4] ..... B65D 91/00

[52] U.S. Cl. ..... 232/34; 232/17

[58] Field of Search ..... 232/17, 34, 35, 37

[56] References Cited

U.S. PATENT DOCUMENTS

| | | | |
|---|---|---|---|
| 2,983,438 | 5/1961 | Brockman | 232/34 |
| 3,482,543 | 12/1969 | Guidos | 232/35 X |
| 3,490,411 | 1/1970 | Poindexter | 232/34 X |
| 3,516,383 | 6/1970 | Goodman | 232/35 |
| 3,596,631 | 8/1971 | Sutton | 232/35 |
| 3,620,443 | 11/1971 | Sturtz et al. | 232/35 |
| 4,372,481 | 2/1983 | Benson | 232/34 |

*Primary Examiner*—Robert P. Swiatek

*Attorney, Agent, or Firm*—Kenneth P. Glynn

[57] ABSTRACT

The present invention is directed to a rural mailbox which has a staff in the solid flag of the conventional type, which flag is rotatably located on the side of the mailbox and can be set in a horizontal or vertical position. The present invention improvement involves an extension signal device which is attached directly to the solid flag. This signal extension device includes a rod which has an upper section and a lower section, with the lower section being threaded, a signal attached to the upper section of the rod, and, a first clamping member and a second clamping member. Both the first clamping member and the second clamping member are located at the lower section of the rod with the first clamping member extended from the rod and clamping over the top edge of the solid flag and with the second clamping member being removably attached to the rod and extending from the rod and clamping over the bottom edge of the solid flag.

15 Claims, 6 Drawing Figures

MAILBOX FLAG EXTENSION DEVICEcl

BACKGROUND OF THE INVENTION

1. Field of the Invention

The present invention is directed to mailbox signaling devices and, more specifically, is directed to a flag extension device for rural-type mailboxes. Thus, the present invention involves a rural mailbox with a unique extension signal device which attaches directly to the solid flag on the conventional rural mailbox.

2. Prior Art Statement

The prior art patents are replete with various designs, configurations and contraptions for signaling devices for mailboxes. Exemplary is U.S. Pat. No. 2,983,438 issued to R. H. Brockman on May 9, 1961. That a patent describes flag mounting attachment for a mailbox which may be readily attached to or detached from the rear end wall of a conventional rural-type mailbox and which, when applied to the mailbox, is capable of functioning efficiently for mounting a flag. The primary object of this prior art is to provide capability of displaying a United States flag or St. Patrick's Day flag or the like for special occasions. Likewise, U.S. Pat. No. 3,482,543 issued to N. R. Guidos on Dec. 9, 1969 described a mailbox signal flag which includes an elongated section of closely wound spiral spring wire, one end of which is engaged in an opening in a bracket which is adhesively mounted to a rural mailbox and the other end of which is engaged in a rigid flag which includes a projecting ribbed element for retention under an adhesively secured bracket on the door of the mailbox. Thus, in this type of signal device, when the mailbox door is opened by the mailman for mail to be put in, the flag pops up and this alerts the home owner to the fact that mail has been delivered. Thus, this patent describes a signaling flag which is opposite to the conventional flag which is usually put up to tell the mailman to stop by and pick up outgoing mail.

U.S. Pat. No. 3,490,411 issued to M. C. Poindexter on Jan. 20, 1970 is also directed to a mail and newspaper box-type flag and, in this case, is generally attached to the top of the box by being clamped. It has a signal member in the form of a resilient tape such as a portion of a tape rule which is adapted to stand erect in its normal position. A hook means is provided so that the flag may be retained in folded over position over the open end of the mailbox. When the mailman or newspaperman makes a delivery into the box, when the box is opened the box disengages the flag member from the hook and permits it to rise to its normally erect position, thereby alerting the home owner to the presence of mail or the newspaper. This device involves a single screw-type mounting device for the flag itself as well as a single screw-type mounting device for the hook which engages and disengages the flag.

U.S. Pat. No. 3,620,443 issued to David Sturtz on Nov. 16, 1971 describes yet another type of mailbox signal flag and this one is likewise attached to the top portion of the typical rural mailbox. The signal flag is supported on the mailbox in position to have the flag-supporting spring standard bent into a loop when the extending free end is secured in a position to be released when the door of the box is opened to indicate that mail has been delivered. When the door is closed, after delivery mail is removed, the home owner secures the flag once again in the releasable position so as to again be alerted upon the next delivery of the mail. This device relies upon a relatively straightforward clamp and hole and is not significantly different from the device of Poindexter except that it was deemed to be patentably distinct by the Patent Office.

U.S. Pat. No. 4,372,481 to Ronald K. Benson on Feb. 8, 1983 is directed to a mailbox marking attachment which is auxiliary to other signals and is made up of a mounting strap traversely surrounding and generally conforming to the shape of the exterior top and sides of the mailbox. A portion of the mounting strap extends inwardly beneath the mailbox such that the mounting strap may be drawn tight to clamp around the mailbox. A flag or other marking device is mounted to the mounting strap by a support attached to the mounting strap and serves as a visible indication of the presence of the mailbox. This device is not one which has a downward and an upward position, but rather is used in general for locating a mailbox such as in a snow storm or when the mailbox could otherwise be blocked from view by obstructions.

The cited prior art above all describes various mechanisms for attachment of signaling devices to rural mailboxes. However, all of these attach the signal devices directly to the mailbox itself and involve various types of attachment mechanisms which, in and of themselves, are in many ways similar. However, these patents do represent the closeness of the prior art and do establish that many types of signaling devices have been patentable. Nonetheless, notwithstanding this prior art, no issued patent has been found which describes or renders obvious the concept of the present invention involving a flag extension which is attached directly to the original flag of a rural-type mailbox.

SUMMARY OF THE INVENTION

The present invention is directed to a rural mailbox which has a staff in the solid flag of the conventional type, which flag is rotatably located on the side of the mailbox and can be set in a horizontal or vertical position. The present invention improvement involves an extension signal device which is attached directly to the solid flag. This signal extension device includes a rod which has an upper section and a lower section, with the lower section being threaded, a signal sttached to the upper section of the rod, and, a first clamping mamber and a second clamping member. Both the first clamping member and the second clamping member are located at the lower section of the rod with the first clamping member extending from the rod and clamping over the top edge of the solid flag and with the second clamping member being removably attached to the rod and extending from the rod and clamping over the bottom edge of the solid flag.

BRIEF DESCRIPTION OF THE DRAWINGS

The present invention will be more fully understood in light of the specification and drawings, wherein.

DETAILED DESCRIPTION OF THE PRESENT INVENTION

Figure 1:
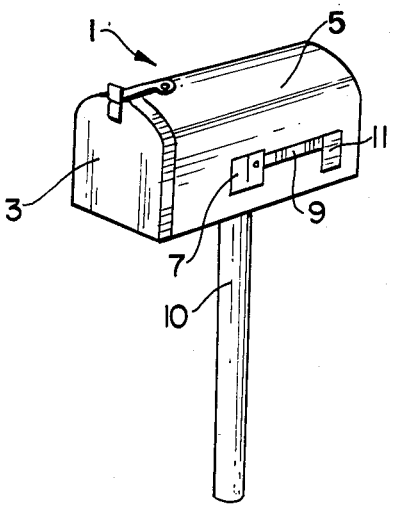
FIG. 1 shows a perspective view of a conventional rural-type mailbox.

FIG. 1 shows a conventional mailbox which is shown generally as mailbox 1 having a front mailbox door 3 and a mailbox body 5. Mailbox 1 is mounted on post 10. There is also shown a conventional solid flag mount 7, a conventional solid flag staff 9 and the conventional solid flag 11. Staff 9 with solid flag 11 can be set in a horizontal or vertical position and is shown here in the vertical, or down position. As is well known, the user typically places outgoing mail in mailbox 1 and raises staff 9 with solid flag 11 to signal to the postman that he should go to that mailbox even if there is no delivery, in order to pick up the outgoing mail. Historically, when the mailman picks up such outgoing mail, he then turns down the staff 9 with solid flag 11 so as to signify to the home owner that the outgoing mail has been picked up.

Figure 2:
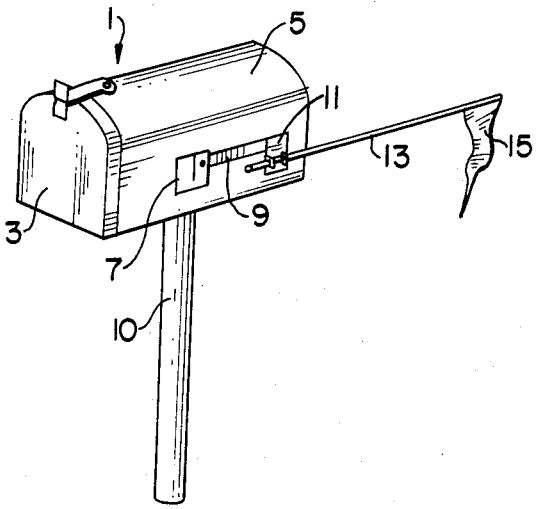
FIG. 2 shows the mailbox of FIG. 1, but including the extension device of the present invention.

FIG. 2 shows a preferred embodiment of the present invention which includes the conventional rural-type mailbox 1 of FIG. 1 wherein like parts are like numbered. However, as shown in FIG. 2, present invention flag extension device 13 is shown as being attached to solid flag 11 and includes signal 15.

Figure 3:
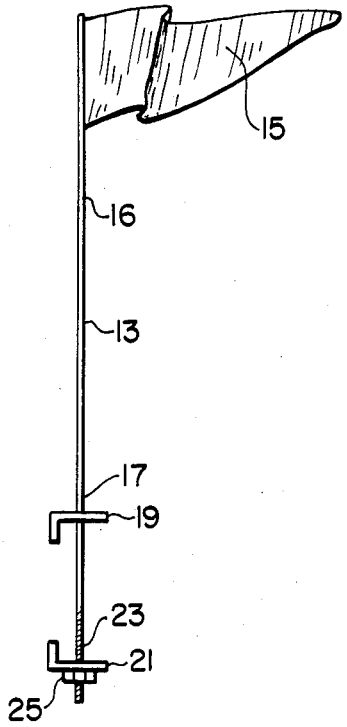
FIG. 3 shows a full side view of one embodiment of the flag extension device of the present invention.

FIG. 3 shows a detailed side view of the present invention flag extension device 13 which is shown in FIG. 2. More specifically, there is an upper section 16 and a lower section 17 along with the signal 15. Signal 15 may be a solid flag which may be plastic or metal, or it may be a flexible plastic or fabric flag. The essential aspect of signal 15 is that it be a noticeable signal and its particular shape or material of construction is not critical.

Also shown in FIG. 3 is first clamping member 19 and second clamping member 21. First clamping member 19, in this embodiment, is welded to rod lower section 17 and second clamping member 21 has an orifice (not shown) through which threads 23 at rod lower section 17 pass and, when in the clamped position, second clamping member 21 is tightened into position with nuts 25 which is screwed onto threads 23.

Figure 4:
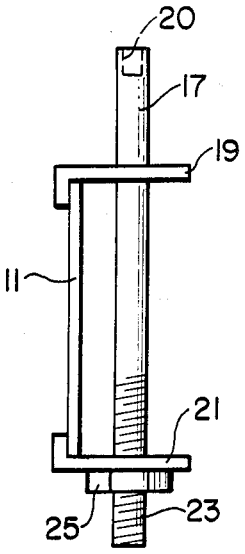
FIG. 4 shows a detailed view of the bottom section of the rod which is shown in FIG. 3, along with the clamping devices and the conventional solid flag.

FIG. 4 shows a detailed side view of rod lower section 17, first clamping member 19, second clamping member 21 and nut 25 in the attached position wherein the assemblage is attached to conventional solid flag 11. Thus, 11 represent a side view of the conventional solid flag which is shown in FIGS. 1 and 2. FIG. 4 shows rod lower section 17 with threads 20 adapted to receive upper section 16 by being screwed therein. Also shown are threads 23 and nut 25 in its fastened position. First clamping member 19, as mentioned, is welded to rod lower section 17 and thus is in a fixed position relative to lower rod section 17. First clamping member 19 extends from rod lower section 17 and clamps over the top edge of solid flag 11. Second clamping 21 is brought up rod lower section 17 such that it extends from the rod and clamps over the bottom edge of solid flag 11 as shown. Nut 25 is tightened so as to squeeze the first clamping member and the second clamping member toward one another in a fashion whereby they tightly clamp rod lower section 17 to conventional solid flag 11.

Figure 5:
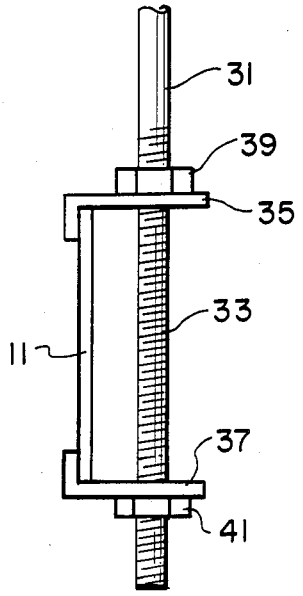
FIG. 5 shows a partial side bottom view of another embodiment of the present invention, including the clamping members and the solid flag; and, FIG. 6 shows the present invention flag extension device on the rural-type mailbox shown in FIG. 2, but with the extension flag in the upright, signaling position.

FIG. 5 shows a side view of a lower portion of an alternative embodiment flag extension device of the present invention. As shown therein, conventional solid flag 11 is again shown. However, in this embodiment, the thread of rod lower section 31 extends further upward and both the first clamping member 35 and the second clamping member 37 are removably attached to rod lower section 31 in that orifices are provided in both of these through which rod lower section 31 may pass. Thus, in this embodiment, nut 39 is first screwed onto thread 33 relatively high up the rod lower section 31. Next, first clamping member 35 is positioned as shown whereby threads 33 are passed through the orifice in first clamping member 35 such that nut 39 rests atop first clamping member 35. First clamping member 35 is brought over the top edge of solid flag 11 and then second clamping member 37 is brought up so that it clamps over the bottom edge of solid flag 11. Last, nut 41 is tightened so as to squeeze first clamping member 35 and the second clamping member 37 together in such a manner that the rod lower section 31 is tightened securely to conventional solid flag 11.

Figure 6:
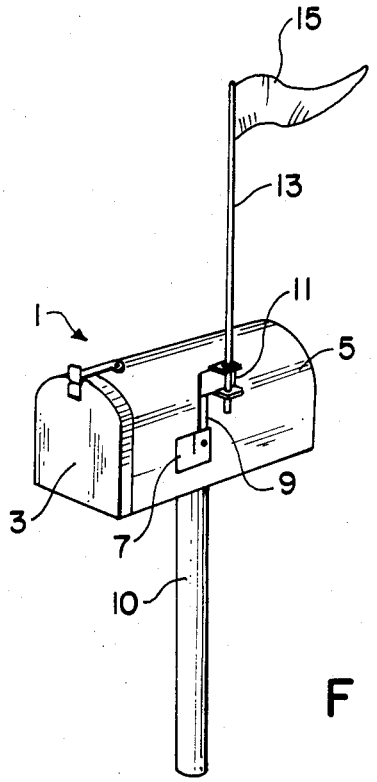

Referring now to FIG. 6, all of the components therein are as represented in FIG. 2 and like parts are like numbered. However, in this case, the flag extension device 13 of the present invention along with the conventional solid flag staff 9 and solid flag 11 are in the upright position, thus warning or alerting the mailman to the fact that there is outgoing mail to be taken.

The obvious advantage to the flag extension device of the present invention is that in rural areas where the mailbox is many hundreds of feet from the household or is otherwise in a relatively obscure location due to shrubbery, rock formations, elevations, or other reasons, the home owner will be able to readily attach the flag extension device of the present invention and will be able to observe directly from some distance whether or not the mailman has arrived to take away outgoing mail and, in the process, perhaps deliver incoming mail.

Obviously, numeraous modifications and variations of the present invention are possible in light of the above teachings. It is therefore understood that within the scope of the appended claims, the invention may be practiced otherwise than as specifically described herein.

What is claimed is:

1. In a rural mailbox having a staff and a solid flag which is rotatably located on the side of said mailbox and can be set in a horizontal or a vertical position, the improvement which comprises an extension signal device attached to said solid flag, said extension signal device comprising:

(a) a rod having an upper section and a lower section, with said lower section being threaded;

(b) a signal attached to the upper section of said rod; and, (c) clamping member and a second clamping member, both being located at the lower section of said rod, said first clamping member extending from said rod and clamping over the top edge of said solid flag and said second clamping member being removably attached to said rod and extending from said rod and clamping over the bottom edge of said solid flag.

2. The device of claim 1 wherein said upper section and lower section of said rod are a single integral piece.

3. The device of claim 2 wherein said first clamping member and said second clamping member are L-shaped, threaded members and are both removably attached to the lower section of said rod.

4. The device of claim 3 wherein said signal is a flag.

5. The device of claim 2 wherein said signal is a flag.

6. The device of claim 2 wherein said first clamping member is permanently attached to the lower section of said rod and said second clamping member is held in place by a tightened nut.

7. The device of claim 1 wherein said upper section and said lower section are made of a plurality of pieces which screw together.

8. The device of claim 7 wherein said first clamping member and said clamping members are L-shaped, threaded members and are both removably attached to the lower section of said rod.

9. The device of claim 8 wherein said signal is a flag.

10. The device of claim 7 wherein said signal is a flag.

11. The device of claim 7 wherein said first clamping member is permanently attached to the lower section of said rod and said second clamping member is held in place by a tightened nut.

12. The device of claim 1 wherein said signal is a flag.

13. The device of claim 12 wherein said flag is a solid plastic flag.

14. The device of claim 12 wherein said flag is a fabric flag.

15. The devices of claim 1 wherein said first clamping member is permanently attached to the lower section of said rod and said second clamping member is held in place by a tightened nut.

* * * * *